US010254016B2

(12) United States Patent
Sata et al.

(10) Patent No.: US 10,254,016 B2
(45) Date of Patent: Apr. 9, 2019

(54) REFRIGERATION CYCLE APPARATUS AND METHOD FOR CONTROLLING REFRIGERATION CYCLE APPARATUS

(71) Applicants: Mitsubishi Electric Corporation, Tokyo (JP); AGC Inc., Tokyo (JP)

(72) Inventors: Hiroshi Sata, Tokyo (JP); Tomotaka Ishikawa, Tokyo (JP); Takashi Ikeda, Tokyo (JP); Yusuke Arii, Tokyo (JP)

(73) Assignees: Mitsubishi Electric Corporation, Tokyo (JP); AGC INC., Tokyo (JP)

( * ) Notice: Subject to any disclaimer, the term of this patent is extended or adjusted under 35 U.S.C. 154(b) by 132 days.

(21) Appl. No.: 15/116,976

(22) PCT Filed: Mar. 17, 2014

(86) PCT No.: PCT/JP2014/057031
§ 371 (c)(1),
(2) Date: Aug. 5, 2016

(87) PCT Pub. No.: WO2015/140873
PCT Pub. Date: Sep. 24, 2015

(65) Prior Publication Data
US 2017/0108247 A1 Apr. 20, 2017

(51) Int. Cl.
*F25B 43/00* (2006.01)
*F25B 7/00* (2006.01)
*F25B 49/02* (2006.01)

(52) U.S. Cl.
CPC ..... *F25B 7/00* (2013.01); *F25B 43/00* (2013.01); *F25B 49/02* (2013.01); *F25B 49/022* (2013.01);
(Continued)

(58) Field of Classification Search
USPC ..... 62/175
See application file for complete search history.

(56) References Cited

U.S. PATENT DOCUMENTS 4,000,626 A * 1/1977 Webber ..... F25B 1/00 62/175
5,170,639 A * 12/1992 Datta ..... F25B 7/00 62/228.3
(Continued)

FOREIGN PATENT DOCUMENTS

CN 103348200 A 10/2013
CN 103562338 A 2/2014
(Continued)

OTHER PUBLICATIONS

Accelerated Sealed Tube Test Procedure for Refrigerant R22 Reactions, Purdue University, 1972.*
(Continued)

*Primary Examiner* — Henry T Crenshaw
(74) *Attorney, Agent, or Firm* — Posz Law Group, PLC

(57) ABSTRACT

A refrigeration cycle apparatus includes: a low-stage refrigeration cycle including a low-stage compressor, a low-stage condenser, a low-stage pressure reducing device, and a low-stage evaporator, and circulating low-stage refrigerant; a high-stage refrigeration cycle including a high-stage compressor, a high-stage condenser, a high-stage pressure reducing device, and a high-stage evaporator, and circulating high-stage refrigerant; a cascade condenser exchanging heat between the low-stage refrigerant in the low-stage condenser and the high-stage refrigerant in the high-stage evaporator, and a controller. The low-stage refrigerant is a refrigerant that undergoes disproportionation. The low-stage refrigerant is maintained at a pressure lower than a disproportionation pressure at which the low-stage refrigerant undergoes disproportionation.

20 Claims, 3 Drawing Sheets

(52) U.S. Cl.
CPC ..... *F25B 2400/16* (2013.01); *F25B 2700/195* (2013.01); *F25B 2700/1933* (2013.01); *F25B 2700/21151* (2013.01); *F25B 2700/21152* (2013.01)

(56) References Cited

U.S. PATENT DOCUMENTS

| | | | | | |
|---|---|---|---|---|---|
| 5,359,859 | A * | 11/1994 | Bench | F25B 45/00 | 62/292 |
| 6,398,507 | B1 * | 6/2002 | Choi | F04C 23/008 | 417/32 |
| 6,405,554 | B1 * | 6/2002 | Kawakatu | F25B 7/00 | 62/175 |
| 2007/0007487 | A1 * | 1/2007 | Wu | C09K 5/045 | 252/67 |
| 2009/0031738 | A1 * | 2/2009 | Tamura | F25B 9/008 | 62/196.1 |
| 2010/0000244 | A1 * | 1/2010 | Kawakatsu | F25B 41/062 | 62/210 |
| 2011/0120165 | A1 * | 5/2011 | Byun | F04C 23/008 | 62/230 |
| 2014/0070132 | A1 * | 3/2014 | Fukushima | F25B 9/002 | 252/67 |

FOREIGN PATENT DOCUMENTS

| | | | |
|---|---|---|---|
| EP | 2679933 | A1 | 1/2014 |
| JP | 2001-091074 | A | 4/2001 |
| JP | 2010-196951 | A | 9/2010 |
| JP | 2013-083407 | A | 5/2013 |
| JP | 2013-160427 | A | 8/2013 |
| WO | 2012/114450 | A1 | 8/2012 |
| WO | 2014/038028 | A1 | 3/2014 |

OTHER PUBLICATIONS

Office Action dated Feb. 1, 2018 issued in corresponding CN patent application No. 201480075170.4 (and English translation thereof).
Extended EP Search Report dated Oct. 17, 2017 issued in corresponding EP patent application No. 14886660.1.
International Search Report of the International Searching Authority dated Jun. 10, 2014 for the corresponding international application No. PCT/JP2014/057031 (and English translation).
Office action dated Sep. 25, 2018 issued in corresponding CN patent application No. 201480075170.4 (and English translation thereof).

* cited by examiner

| MOLAR RATIO OF HFO-1123 REFRIGERANT | PRESSURE (MPa) | | |
|---|---|---|---|
| | 2.0 | 3.5 | 4.0 |
| 50% | (○) | (○) | ○ |
| 60% | (○) | (○) | ○ |
| 70% | (○) | ○ | × |
| 80% | ○ | (×) | (×) |
| 90% | × | (×) | (×) |
| 100% | (×) | (×) | (×) |

○: NO DISPROPORTIONATION ×: DISPROPORTIONATION (): ESTIMATION BASED ON ANOTHER RESULT

REFRIGERATION CYCLE APPARATUS AND METHOD FOR CONTROLLING REFRIGERATION CYCLE APPARATUS

CROSS REFERENCE TO RELATED APPLICATION

This application is a U.S. national stage application of PCT/JP2014/057031 filed on Mar. 17, 2014, the contents of which are incorporated herein by reference.

TECHNICAL FIELD

The present invention relates to a multi-stage cascade refrigeration cycle apparatus including multiple refrigeration cycles and a method for controlling the multi-stage cascade refrigeration cycle apparatus.

BACKGROUND ART

A related-art refrigeration cycle apparatus includes: a low-stage refrigeration cycle that includes a low-stage compressor, a low-stage condenser, a low-stage pressure reducing device, and a low-stage evaporator, and circulates low-stage refrigerant; a high-stage refrigeration cycle that includes a high-stage compressor, a high-stage condenser, a high-stage pressure reducing device, and a high-stage evaporator, and circulates high-stage refrigerant, a cascade condenser exchanging heat between the low-stage refrigerant in the low-stage condenser and the high-stage refrigerant in the high-stage evaporator, and a controller. Such a refrigeration cycle apparatus uses $CO_2$ refrigerant as the low-stage refrigerant (refer to Patent Literature 1).

CITATION LIST

Patent Literature

Patent Literature 1: Japanese Unexamined Patent Application Publication No. 2001-91074 (paragraphs [0007] to [0013], FIGS. 1 to 4)

SUMMARY OF INVENTION

Technical Problem

In such a refrigeration cycle apparatus, the low-stage refrigeration cycle may be controlled at or below a pressure of 7.4 MPa, which is the critical pressure of $CO_2$ refrigerant. If the refrigeration cycle apparatus uses, as the low-stage refrigerant, for example, HFO-1123 refrigerant (1,1,2-trifluoroethylene refrigerant) that allows its pressure range to be lower than that in the use of $CO_2$ refrigerant, the safety of the refrigeration cycle apparatus can be improved. In addition, the pressure resistance of each component of the low-stage refrigeration cycle can be reduced, thus reducing the cost of the refrigeration cycle apparatus.

When the evaporating temperature is 10 degrees C., the condensing temperature is 45 degrees C., the degree of supercooling is 0 K, and the degree of superheat is 0 K, the coefficient of performance (COP) of the theoretical cycle using $CO_2$ refrigerant is 5.70. The COP with HFC (hydrofluorocarbon) −32 refrigerant in this condition is 6.33. The COP with HFC-410A refrigerant in this condition is 6.06. When the evaporating temperature is −30 degrees C., the condensing temperature is 45 degrees C., the degree of supercooling is 0 K, and the degree of superheat is 0 K, the COP of the theoretical cycle using $CO_2$ refrigerant is 1.94. The COP with HFC-32 refrigerant in this condition is 2.13. The COP with HFC-410A refrigerant in this condition is 1.99 (cited from "SI Niyoru Jokyu Reito Juken Tekisuto (Advanced Level Examination Textbook of Refrigeration in SI units)", Seventh Revised Edition, Japan Society of Refrigerating and Air Conditioning Engineers). In other words, the COP of the theoretical cycle using $CO_2$ refrigerant as the low-stage refrigerant may be lower than that using a HFC-based refrigerant as the low-stage refrigerant. If the above-described refrigeration cycle apparatus uses, as the low-stage refrigerant, for example, HFO-1123 refrigerant that allows the COP of the theoretical cycle to be substantially equal to that using, for example, a HFC-based refrigerant, the operating efficiency of the refrigeration cycle apparatus can be improved.

Furthermore, if the low-stage refrigerant used is, for example, HFO-1123 refrigerant that has a global warming potential (GWP) lower than or substantially equal to that of $CO_2$ refrigerant, the effect of the refrigeration cycle apparatus on global warming can be reduced.

However, HFO-1123 refrigerant is a refrigerant that undergoes disproportionation, and a technique for operating a refrigeration cycle apparatus using such a refrigerant as low-stage refrigerant has not been established. There is little possibility of, for example, improved safety of a refrigeration cycle apparatus using such a refrigerant as low-stage refrigerant, reduced cost of the apparatus, improved operating efficiency of the apparatus, and reduced effect of the apparatus on global warming.

The present invention has been made in view of the above-described problems. An embodiment of the present invention aims to establish a technique for operating a refrigeration cycle apparatus using, as low-stage refrigerant, a refrigerant that undergoes disproportionation and provide a refrigeration cycle apparatus with increased possibility, achieved by the above-described technique, of improved safety, reduced cost, improved operating efficiency, reduced effect on global warming and so on. Another embodiment of the present invention aims to provide a method for controlling such a refrigeration cycle apparatus.

Solution to Problem

A refrigeration cycle apparatus according to one embodiment of the present invention includes: a low-stage refrigeration cycle including a low-stage compressor, a low-stage condenser, a low-stage pressure reducing device, and a low-stage evaporator, and circulating low-stage refrigerant; a high-stage refrigeration cycle including a high-stage compressor, a high-stage condenser, a high-stage pressure reducing device, and a high-stage evaporator, and configured to circulate high-stage refrigerant; a cascade condenser configured to exchange heat between the low-stage refrigerant in the low-stage condenser and the high-stage refrigerant in the high-stage evaporator; and a controller, the low-stage refrigerant being a refrigerant that undergoes disproportionation, the low-stage refrigerant being maintained at a pressure lower than a disproportionation pressure at which the low-stage refrigerant undergoes disproportionation.

Advantageous Effects of Invention

In the refrigeration cycle apparatus according to this embodiment of the present invention, the low-stage refrigerant is maintained at a pressure lower than the disproportionation pressure of the low-stage refrigerant. Although the low-stage refrigerant is a refrigerant that undergoes disproportionation, the refrigeration cycle apparatus can be operated as if the low-stage refrigerant were not a refrigerant that undergoes disproportionation. This increases the possibility of, for example, improved safety of the refrigeration cycle apparatus, reduced cost of the apparatus, improved energy-saving performance of the apparatus, and reduced effect of the apparatus on global warming.

DESCRIPTION OF EMBODIMENTS

Figure 1:
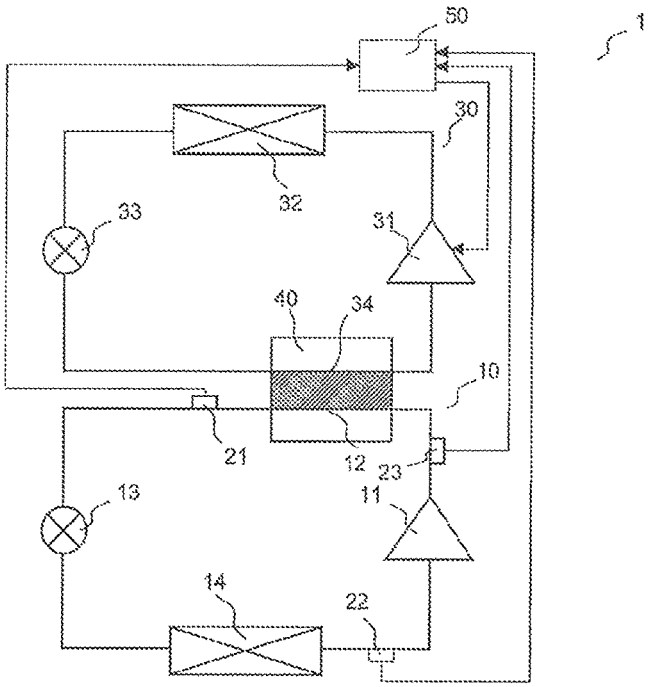
FIG. 1 is a diagram explaining the configuration of a refrigeration cycle apparatus according to Embodiment 1.

Refrigeration cycle apparatuses according to the present invention will be described below with reference to the drawings.

In the following description, for example, configurations and operations are for illustrative purposes only, and should not be construed as limiting the refrigeration cycle apparatuses according to the present invention. In the drawings, the illustration of detailed structures may be simplified or omitted appropriately. Furthermore, redundant or similar descriptions may be simplified or omitted appropriately.

Embodiment 1

A refrigeration cycle apparatus according to Embodiment 1 will now be described.

<Configuration of Refrigeration Cycle Apparatus>

The configuration of the refrigeration cycle apparatus according to Embodiment 1 will be described below.

Figure 2:
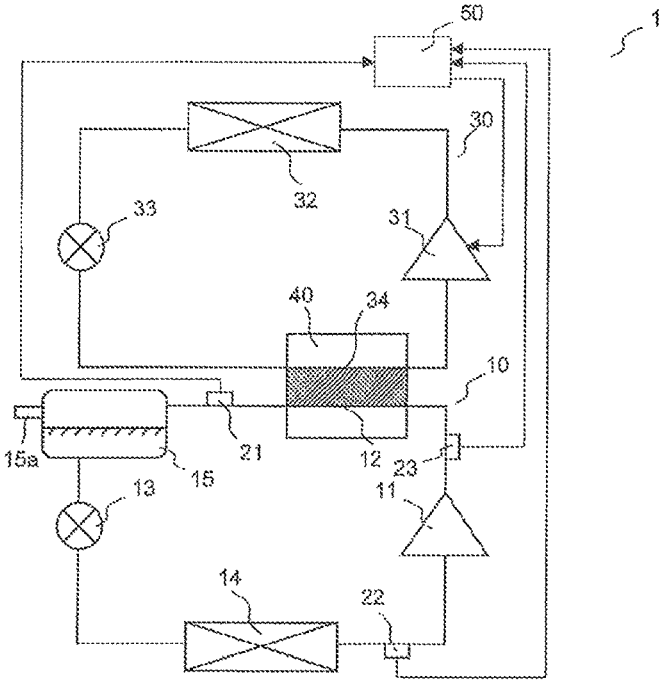
FIG. 2 is a diagram explaining another configuration of the refrigeration cycle apparatus according to Embodiment 1.

FIGS. 1 and 2 are diagrams explaining the configuration of the refrigeration cycle apparatus according to Embodiment 1.

As illustrated in FIGS. 1 and 2, a refrigeration cycle apparatus 1 includes a two-stage refrigerant circuit including a low-stage refrigeration cycle 10 and a high-stage refrigeration cycle 30. The refrigeration cycle apparatus 1 may include three or more refrigeration cycles.

The low-stage refrigeration cycle 10 includes a low-stage compressor 11, a low-stage condenser 12, a low-stage expansion valve 13 that serves as a low-stage pressure reducing device, and a low-stage evaporator 14, and circulates low-stage refrigerant. For example, if the amount of refrigerant necessary for the low-stage refrigeration cycle 10 significantly fluctuates in response to a change in operating conditions, a low-stage liquid receiver 15 may be provided in a pipe providing communication between the low-stage condenser 12 and the low-stage expansion valve 13, as illustrated in FIG. 2. The low-stage expansion valve 13 may be any other pressure reducing device, such as a capillary tube. The low-stage evaporator 14 is used as a cooling energy source. The low-stage refrigerant is a refrigerant that undergoes disproportionation, such as HFO-1123 refrigerant.

The high-stage refrigeration cycle 30 includes a high-stage compressor 31, a high-stage condenser 32, a high-stage expansion valve 33 that serves as a high-stage pressure reducing device, and a high-stage evaporator 34, and circulates high-stage refrigerant. The high-stage compressor 31 is of a variable capacity type. The high-stage expansion valve 33 may be any other pressure reducing device, such as a capillary tube.

The low-stage condenser 12 and the high-stage evaporator 34 are included in a cascade condenser 40. In the cascade condenser 40, the low-stage refrigerant in the low-stage condenser 12 exchanges heat with the high-stage refrigerant in the high-stage evaporator 34.

The high-stage refrigerant is, for example, an HFC-based refrigerant that has a high GWP. Since the high-stage refrigeration cycle 30 has a structure less likely to leak the high-stage refrigerant such that the high-stage evaporator 34 is included in the cascade condenser 40, the environment is little affected by the use of such a refrigerant. In addition, HFC-based refrigerants provide higher COPs than those provided by other refrigerants, and thus allows improvement of the operating efficiency of the high-stage refrigeration cycle 30. The high-stage refrigerant may be any other refrigerant that has a higher GWP than HFC-based refrigerants. For example, HFO-1234yf refrigerant (2,3,3,3-tetrafluoropropene refrigerant), a HC-based refrigerant, $CO_2$ refrigerant, or water may be used. In other words, the high-stage refrigerant is a refrigerant that allows the operating efficiency of a refrigeration cycle to be higher than that of the refrigeration cycle using the low-stage refrigerant.

If the high-stage refrigerant is a refrigerant having a high critical point, such as a HFC-based refrigerant, a high-stage liquid receiver may be provided on a high-pressure side of the high-stage refrigeration cycle 30 so that an excess of refrigerant can be processed. If the high-stage refrigerant is a refrigerant having a low critical point, such as $CO_2$ refrigerant, a high-stage accumulator may be provided on a low-pressure side of the high-stage refrigeration cycle 30 so that an excess of refrigerant can be processed.

The low-stage refrigeration cycle 10 further includes a low-stage high-pressure side pressure sensor 21, serving as a low-stage high-pressure side pressure detecting unit that detects a high-pressure side pressure in the low-stage refrigeration cycle 10, a low-stage low-pressure side pressure sensor 22, serving as a low-stage low-pressure side pressure detecting unit that detects a low-pressure side pressure in the low-stage refrigeration cycle 10, and a low-stage discharge temperature sensor 23, serving as a low-stage discharge temperature detecting unit that detects the temperature of the low-stage refrigerant discharged from the low-stage compressor 11. The low-stage high-pressure side pressure sensor 21 is provided in the pipe providing communication between the low-stage condenser 12 and the low-stage expansion valve 13. The low-stage low-pressure side pressure sensor 22 is provided in a pipe providing communication between the low-stage evaporator 14 and the low-stage compressor 11. The low-stage discharge temperature sensor 23 is provided in a pipe providing communication between the low-stage compressor 11 and the low-stage condenser 12. If any of the sensors is not used in an operation which will be described later, the sensor may be omitted.

The low-stage high-pressure side pressure sensor 21 and the low-stage low-pressure side pressure sensor 22 may detect the pressure of the low-stage refrigerant or may detect any other physical quantity that can be converted into the pressure of the low-stage refrigerant. In other words, each of the low-stage high-pressure side pressure detecting unit and the low-stage low-pressure side pressure detecting unit in the present invention may be a detecting unit that substantially detects a pressure. Furthermore, the low-stage discharge temperature sensor 23 may detect a discharge temperature of the low-stage refrigerant or may detect any other physical quantity that can be converted into the discharge temperature of the low-stage refrigerant.

A detection signal of the low-stage high-pressure side pressure sensor 21, a detection signal of the low-stage low-pressure side pressure sensor 22, and a detection signal of the low-stage discharge temperature sensor 23 are input to a controller 50. The controller 50 controls overall operation of the refrigeration cycle apparatus 1. The whole or parts of the controller 50 may include a microcomputer, a microprocessor unit, an updatable component, such as firmware, or a program module that is executed in response to an instruction from, for example, a central processing unit (CPU).

<Operation of Refrigeration Cycle Apparatus>

An operation of the refrigeration cycle apparatus according to Embodiment 1 will now be described.

In the low-stage refrigeration cycle 10, the low-stage refrigerant is compressed by and discharged from the low-stage compressor 11 and is then cooled by the low-stage condenser 12 in the cascade condenser 40. After that, the pressure of the low-stage refrigerant is reduced by the low-stage expansion valve 13. The low-stage refrigerant, pressure-reduced by the low-stage expansion valve 13, evaporates in the low-stage evaporator 14 and then returns to the low-stage compressor 11 through a suction pipe.

In the high-stage refrigeration cycle 30, the high-stage refrigerant is compressed by and discharged from the high-stage compressor 31 and then transfers heat and condenses in the high-stage condenser 32, serving as an air heat exchanger. After that, the pressure of the high-stage refrigerant is reduced by the high-stage expansion valve 33. In the high-stage evaporator 34 in the cascade condenser 40, the high-stage refrigerant, pressure-reduced by the high-stage expansion valve 33, evaporates while exchanging heat with the refrigerant in the low-stage condenser 12. The high-stage refrigerant then returns to the high-stage compressor 31.

Figures 3, 4:
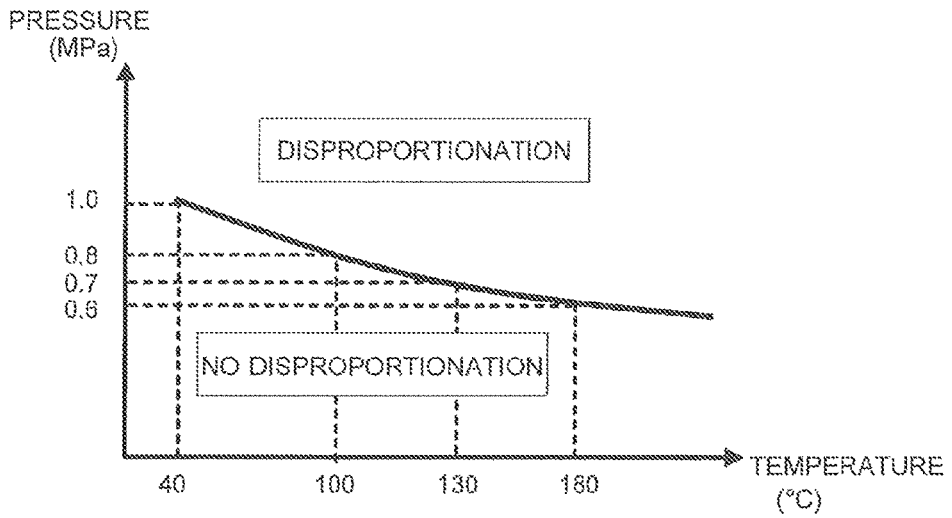
FIG. 3 is a graph explaining the properties of HFO-1123 refrigerant used as low-stage refrigerant of the refrigeration cycle apparatus according to Embodiment 1.
FIG. 4 is a table explaining the properties of a refrigerant mixture of HFO-1123 refrigerant and HFO-1234yf refrigerant used as the low-stage refrigerant of the refrigeration cycle apparatus according to Embodiment 1.

FIG. 3 is a graph explaining the properties of HFO-1123 refrigerant used as the low-stage refrigerant of the refrigeration cycle apparatus 1 according to Embodiment 1.

In the case where the low-stage refrigerant is HFO-1123 refrigerant, as illustrated in FIG. 3, high pressures cause the low-stage refrigerant to undergo disproportionation. A disproportionation pressure at which the low-stage refrigerant undergoes disproportionation decreases with increasing temperature. In other words, if the pressure remains unchanged, the low-stage refrigerant will undergo disproportionation at high temperatures. For example, when the temperature is approximately 120 degrees C., the low-stage refrigerant undergoes disproportionation at pressures above 0.7 MPa. When the pressure is 0.7 MPa, the low-stage refrigerant undergoes disproportionation at temperatures above 120 degrees C. The disproportionation of HFO-1123 refrigerant, serving as the low-stage refrigerant, is expressed by Reaction Formula (1).

[Chem. 1]

$$CF_2{=}CHF \rightarrow 1/2CF_4 + 3/2C + HF \quad (1)$$

FIG. 4 is a table explaining the properties of a refrigerant mixture of HFO-1123 refrigerant and HFO-1234yf refrigerant used as the low-stage refrigerant of the refrigeration cycle apparatus according to Embodiment 1.

In the case where the low-stage refrigerant is the refrigerant mixture of HFO-1123 refrigerant and HFO-1234yf refrigerant, as illustrated in FIG. 4, the disproportionation pressure can be increased. Furthermore, a disproportionation temperature at which disproportionation occurs can also be increased. In other words, disproportionation can be made less likely to occur than in the case where the low-stage refrigerant is HFO-1123 refrigerant. As the molar ratio of HFO-1123 refrigerant to HFO-1234yf refrigerant decreases, or as the mixture ratio of HFO-1234yf refrigerant to HFO-1123 refrigerant increases, the disproportionation pressure rises.

In the case where the low-stage refrigerant is a refrigerant mixture of HFO-1123 refrigerant and HFC-32 refrigerant, the disproportionation pressure can be further increased as compared with that in the case where the low-stage refrigerant is the refrigerant mixture of HFO-1123 refrigerant and HFO-1234yf refrigerant. In addition, the disproportionation temperature can also be further increased.

If the low-stage refrigerant undergoes disproportionation, reaction products of the disproportionation would accelerate decomposition, causing an adverse effect on, for example, the operation of the refrigeration cycle apparatus 1. To reduce a likelihood that the high-pressure side pressure in the low-stage refrigeration cycle 10 may increase to a value higher than the disproportionation pressure of the low-stage refrigerant, therefore, the low-stage refrigerant is preferably the refrigerant mixture of HFO-1123 refrigerant and HFO-1234yf refrigerant, since the disproportionation pressure of the refrigerant mixture is higher than that of HFO-1123 refrigerant. The low-stage refrigerant is more preferably the refrigerant mixture of HFO-1123 refrigerant and HFC-32 refrigerant, since the disproportionation pressure of this refrigerant mixture is higher than that of the refrigerant mixture of HFO-1123 refrigerant and HFO-1234yf refrigerant. Assuming that the low-stage refrigerant is any of these refrigerant mixtures, however, if the high-pressure side pressure of the low-stage refrigeration cycle 10 rises, disproportionation would occur.

For the above reasons, the high-pressure side pressure of the low-stage refrigeration cycle 10 in the refrigeration cycle apparatus 1 is maintained at a lower pressure than the disproportionation pressure of the low-stage refrigerant.

Examples of implementation will now be described.

All of or some of the examples may be combined.

Example 1

The controller 50 controls an operation state (e.g., a rotation speed) of the high-stage compressor 31 such that an operating pressure (low-pressure side pressure) of the high-stage refrigeration cycle 30 decreases when a cooling load on the low-stage refrigeration cycle 10 increases, whereas the operating pressure (low-pressure side pressure) of the high-stage refrigeration cycle 30 increases when the cooling load on the low-stage refrigeration cycle 10 decreases. A decrease in operating pressure (low-pressure side pressure) of the high-stage refrigeration cycle 30 increases the difference between the high-pressure side pressure of the low-stage refrigeration cycle 10 and the low-pressure side pressure of the high-stage refrigeration cycle 30, resulting in a decrease in high-pressure side pressure of the low-stage refrigeration cycle 10. An increase in operating pressure (low-pressure side pressure) of the high-stage refrigeration cycle 30 reduces the difference between the high-pressure side pressure of the low-stage refrigeration cycle 10 and the low-pressure side pressure of the high-stage refrigeration cycle 30, resulting in an increase in high-pressure side pressure of the low-stage refrigeration cycle 10. Controlling the operation state (e.g., the rotation speed) of the high-stage compressor 31 in the above-described manner increases or reduces the amount of heat transferred from the low-stage refrigerant to the high-stage refrigerant. If the cooling load on the low-stage refrigeration cycle 10 changes, the high-pressure side pressure of the low-stage refrigeration cycle 10 can be maintained at a value below the disproportionation pressure of the low-stage refrigerant.

Example 2

The controller 50 controls the operation state (e.g., the rotation speed) of the high-stage compressor 31 such that the high-pressure side pressure detected by the low-stage high-pressure side pressure sensor 21 is maintained at a value below the disproportionation pressure of the low-stage refrigerant. Controlling the operation state (e.g., the rotation speed) of the high-stage compressor 31 in the above-described manner increases or reduces the amount of heat transferred from the low-stage refrigerant to the high-stage refrigerant. If the cooling load on the low-stage refrigeration cycle 10 changes, the high-pressure side pressure of the low-stage refrigeration cycle 10 can be maintained at a value below the disproportionation pressure of the low-stage refrigerant. The controller 50 may control the operation state (e.g., the rotation speed) of the high-stage compressor 31 such that the discharge temperature detected by the low-stage discharge temperature sensor 23 is maintained at a value below the disproportionation temperature of the low-stage refrigerant.

Example 3

The low-stage refrigeration cycle 10 includes a pressure relief device that opens when the pressure or temperature of the low-stage refrigerant increases to a reference value. The pressure relief device allows the low-stage refrigerant to be maintained at a pressure below the disproportionation pressure of the low-stage refrigerant. For example, as illustrated in FIG. 2, the low-stage liquid receiver 15 is provided with a fusible plug 15*a*, serving as a pressure relief device. When the pressure or temperature of the low-stage refrigerant increases to the reference value, low-melting part of the fusible plug 15*a* is molten, thus forming a hole in the fusible plug 15*a*. Consequently, the low-stage refrigerant is maintained at a pressure below the disproportionation pressure of the low-stage refrigerant. The controller 50 may stop the low-stage compressor 11 when the high-pressure side pressure detected by the low-stage high-pressure side pressure sensor 21 increases to a reference value or when the discharge temperature detected by the low-stage discharge temperature sensor 23 increases to a reference value.

Example 4

The controller 50 controls the operation state (e.g., the rotation speed) of the high-stage compressor 31 such that the high-pressure side pressure detected by the low-stage high-pressure side pressure sensor 21 is a geometric mean of the disproportionation pressure of the low-stage refrigerant and the low-pressure side pressure detected by the low-stage low-pressure side pressure sensor 22.

Controlling the operation state (e.g., the rotation speed) of the high-stage compressor 31 in the above-described manner allows the high-pressure side pressure of the low-stage refrigeration cycle 10 to be an intermediate pressure between the disproportionation pressure of the low-stage refrigerant and the low-pressure side pressure of the low-stage refrigeration cycle 10. Consequently, the high-pressure side pressure of the low-stage refrigeration cycle 10 can be maintained at a value below the disproportionation pressure of the low-stage refrigerant and an increase in discharge temperature of the refrigerant discharged from the low-stage compressor 11 can be suppressed.

In addition, the high-pressure side pressure of the low-stage refrigeration cycle 10 decreases and the compression ratio of the high-stage compressor 31 increases, so that the operating efficiency is improved, thus achieving energy saving in the refrigeration cycle apparatus 1. In particular, if the high-stage refrigerant is, for example, a HFC-based refrigerant, energy saving in the refrigeration cycle apparatus 1 is further improved. For example, assuming that the outdoor temperature is 32 degrees C. and the evaporating temperature of the low-stage evaporator 14 is in a range from −10 degrees C. to −40 degrees C., if the high-stage refrigerant is HFC-410A refrigerant, the operating efficiency of the refrigeration cycle apparatus 1 can be substantially maximized.

<Behavior of Refrigeration Cycle Apparatus>

The behavior of the refrigeration cycle apparatus according to Embodiment 1 will now be described.

In the refrigeration cycle apparatus 1, the low-stage refrigerant is maintained at a pressure lower than the disproportionation pressure of the low-stage refrigerant. Although the low-stage refrigerant is a refrigerant that undergoes disproportionation, such as HFO-1123 refrigerant, the refrigeration cycle apparatus 1 can be operated as if the low-stage refrigerant were not a refrigerant that undergoes disproportionation. This increases the possibility of, for example, improved safety of the refrigeration cycle apparatus 1, reduced cost of the refrigeration cycle apparatus 1, improved energy-saving performance of the refrigeration cycle apparatus 1, and reduced effect of the refrigeration cycle apparatus 1 on global warming.

Although, for example, HFO-1123 refrigerant, the refrigerant mixture of HFO-1123 refrigerant and HFC-32 refrigerant, and the refrigerant mixture of HFO-1123 refrigerant and HFO-1234yf refrigerant are refrigerants that undergo disproportionation, these refrigerants enable the upper limit pressure of the low-stage refrigeration cycle 10 to be lower than that using $CO_2$ refrigerant. Consequently, the refrigeration cycle apparatus 1 using such a refrigerant as the low-stage refrigerant can be operated as if the low-stage refrigerant were not a refrigerant that undergoes disproportionation. This can improve the safety of the refrigeration cycle apparatus 1, reduce the pressure resistance of each component of the low-stage refrigeration cycle 10, and thus reduce the cost of the refrigeration cycle apparatus 1.

Although, for example, HFO-1123 refrigerant, the refrigerant mixture of HFO-1123 refrigerant and HFC-32 refrigerant, and the refrigerant mixture of HFO-1123 refrigerant and HFO-1234yf refrigerant are refrigerants that undergo disproportionation, these refrigerants allow the COP of the theoretical cycle to be substantially equal to that using a HFC-based refrigerant, for example. Consequently, the refrigeration cycle apparatus 1 using such a refrigerant as the low-stage refrigerant can be operated as if the low-stage refrigerant were not a refrigerant that undergoes disproportionation. This can improve the operating efficiency of the refrigeration cycle apparatus 1.

Although, for example, HFO-1123 refrigerant, the refrigerant mixture of HFO-1123 refrigerant and HFC-32 refrigerant, and the refrigerant mixture of HFO-1123 refrigerant and HFO-1234yf refrigerant are refrigerants that undergo disproportionation, these refrigerants have a GWP lower than or substantially equal to that of $CO_2$ refrigerant. Consequently, the refrigeration cycle apparatus 1 using such a refrigerant as the low-stage refrigerant can be operated as if the low-stage refrigerant were not a refrigerant that undergoes disproportionation. This can improve the effect of the refrigeration cycle apparatus 1 on global warming.

Furthermore, in the case where the low-stage refrigerant is the refrigerant mixture of HFO-1123 refrigerant and HFC-32 refrigerant or the refrigerant mixture of HFO-1123 refrigerant and HFO-1234yf refrigerant, the disproportionation pressure of the low-stage refrigerant can be made higher than that of HFO-1123 refrigerant used as the low-stage refrigerant. This increases the reliability with which the refrigeration cycle apparatus 1 using such a refrigerant as the low-stage refrigerant is operated as if the low-stage refrigerant were not a refrigerant that undergoes disproportionation.

The refrigeration cycle apparatus 1 may be a refrigerating device or a freezing device, such as a showcase, an industrial refrigerator-freezer, or a vending machine, required to be free from chlorofluorocarbons (CFCs) or reduce the amount of CFC refrigerant used, or achieve energy saving.

Embodiment 2

A refrigeration cycle apparatus according to Embodiment 2 will now be described.

A description overlapping or similar to that in Embodiment 1 is simplified or omitted appropriately.

<Configuration of Refrigeration Cycle Apparatus>

The configuration of the refrigeration cycle apparatus according to Embodiment 2 will be described below.

Figure 5:
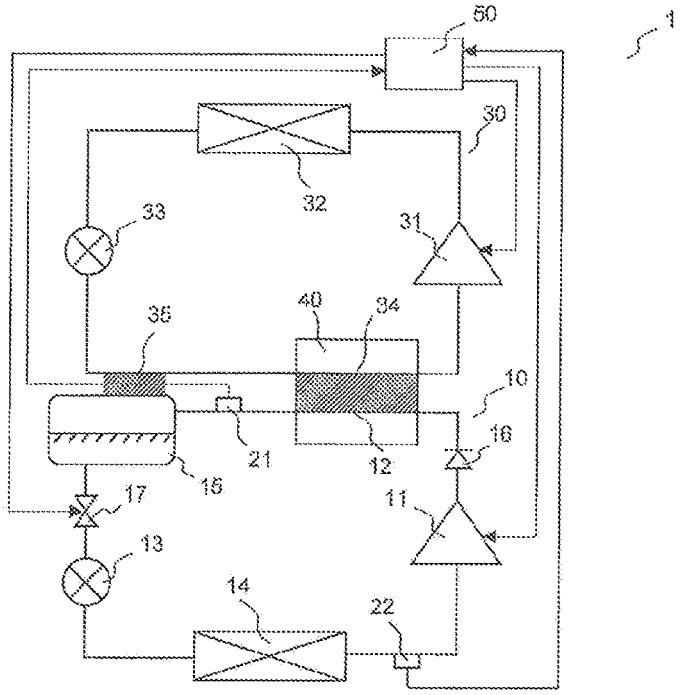
FIG. 5 is a diagram explaining the configuration of a refrigeration cycle apparatus according to Embodiment 2.

FIG. 5 is a diagram explaining the configuration of the refrigeration cycle apparatus according to Embodiment 2.

As illustrated in FIG. 5, the low-stage refrigeration cycle 10 includes the low-stage liquid receiver 15 provided in the pipe providing communication between the low-stage condenser 12 and the low-stage expansion valve 13, a check valve 16 provided in the pipe providing communication between the low-stage compressor 11 and the low-stage condenser 12, and a solenoid valve 17, serving as a valve, provided in a pipe providing communication between the low-stage liquid receiver 15 and the low-stage expansion valve 13.

The high-stage refrigeration cycle 30 includes a cooler 35, serving as a cooling unit that cools the low-stage refrigerant. The cooler 35 is, for example, a pipe providing communication between the high-stage expansion valve 33 and the high-stage evaporator 34 in the high-stage refrigeration cycle 30. For example, the pipe is disposed so as to extend through the low-stage liquid receiver 15, thus cooling the low-stage refrigerant in the low-stage liquid receiver 15.

<Operation of Refrigeration Cycle Apparatus>

An operation of the refrigeration cycle apparatus according to Embodiment 2 will now be described.

In a normal operation, the controller 50 allows the low-stage refrigerant cycle 10 to circulate the low-stage refrigerant and allows the high-stage refrigeration cycle 30 to circulate the high-stage refrigerant as in Embodiment 1. In some cases, the low-stage compressor 11 is intermittently operated for temperature control, for example. When the low-stage compressor 11 is stopped in such a case, the controller 50 closes the solenoid valve 17 and continues to operate the low-stage compressor 11 for a predetermined period of time before the low-stage compressor 11 is stopped. Such an operation of the controller 50 allows the low-stage refrigerant in the low-stage refrigeration cycle 10 to be stored at a high pressure between the check valve 16 and the solenoid valve 17 in the low-stage refrigeration cycle 10, particularly in the low-stage liquid receiver 15. The low-stage compressor 11 is stopped under the above-described conditions.

The controller 50 operates the high-stage compressor 31 while the low-stage compressor 11 is not operating. Such an operation of the controller 50 allows the low-stage refrigerant in the low-stage condenser 12 to be cooled by the high-stage refrigerant in the high-stage evaporator 34 in the cascade condenser 40. For example, if the ambient temperature rises, the refrigerant in the low-stage refrigeration cycle 10 will be maintained at a high density, thus suppressing an increase in pressure of the low-stage refrigerant.

In addition, the cooler 35 cools the inside of the low-stage liquid receiver 15. Since a large amount of low-stage refrigerant is stored in the low-stage liquid receiver 15, the low-stage refrigerant is effectively cooled, thus further suppressing an increase in pressure of the low-stage refrigerant.

<Behavior of Refrigeration Cycle Apparatus>

The behavior of the refrigeration cycle apparatus according to Embodiment 2 will now be described.

In the refrigeration cycle apparatus 1, when the low-stage compressor 11 is stopped, the low-stage refrigerant is maintained at a pressure lower than the disproportionation pressure of the low-stage refrigerant. Although the low-stage refrigerant is a refrigerant that undergoes disproportionation, such as HFO-1123 refrigerant, the refrigeration cycle apparatus 1 can be operated as if the low-stage refrigerant were not a refrigerant that undergoes disproportionation. This increases the possibility of, for example, improved safety of the refrigeration cycle apparatus 1, reduced cost of the refrigeration cycle apparatus 1, improved energy-saving performance of the refrigeration cycle apparatus 1, and reduced effect of the refrigeration cycle apparatus 1 on global warming.

Embodiment 3

A refrigeration cycle apparatus according to Embodiment 3 will now be described.

A description overlapping or similar to those in Embodiments 1 and 2 is simplified or omitted appropriately.

<Configuration of Refrigeration Cycle Apparatus>

The configuration of the refrigeration cycle apparatus according to Embodiment 3 will be described below.

Figure 6:
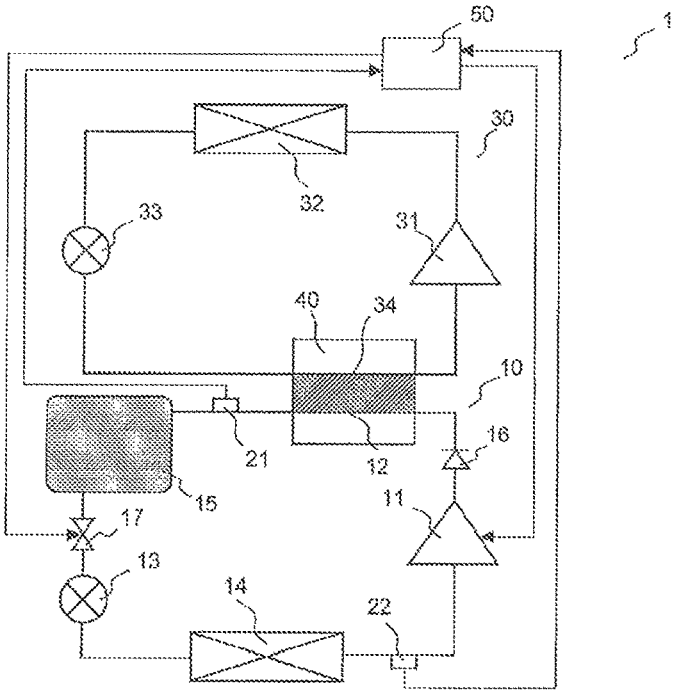
FIG. 6 is a diagram explaining the configuration of a refrigeration cycle apparatus according to Embodiment 3.

FIG. 6 is a diagram explaining the configuration of the refrigeration cycle apparatus according to Embodiment 3.

As illustrated in FIG. 6, the low-stage refrigeration cycle 10 includes the low-stage liquid receiver 15 provided in the pipe providing communication between the low-stage condenser 12 and the low-stage expansion valve 13, the check valve 16 provided in the pipe providing communication between the low-stage compressor 11 and the low-stage condenser 12, and the solenoid valve 17 provided in the pipe providing communication between the low-stage liquid receiver 15 and the low-stage expansion valve 13. The high-stage refrigeration cycle 30 may include the cooler 35 as in Embodiment 2 or may exclude the cooler 35.

The low-stage liquid receiver 15 has such a capacity that when a pressure inside the low-stage liquid receiver 15 is lower than the disproportionation pressure of the low-stage refrigerant, the entire low-stage refrigerant in a liquid state can be stored between the check valve 16 and the solenoid valve 17. Specifically, a maximum volume of the low-stage refrigerant in a liquid state is obtained based on the total amount of low-stage refrigerant enclosed in the low-stage refrigeration cycle 10 and the estimated highest temperature of ambient air. The capacity of the low-stage liquid receiver 15 is set so that the total capacity of the components providing communication between the check valve 16 and the solenoid valve 17 is greater than the maximum volume. The total capacity of the components providing communication between the check valve 16 and the solenoid valve 17 is the sum of the capacity of the low-stage liquid receiver 15 and, for example, the capacity of the low-stage condenser 12, the capacity of a pipe providing communication between the check valve 16 and the low-stage condenser 12, the capacity of a pipe providing communication between the low-stage condenser 12 and the low-stage liquid receiver 15, and the capacity of a pipe providing communication between the low-stage liquid receiver 15 and the solenoid valve 17.

<Operation of Refrigeration Cycle Apparatus>

An operation of the refrigeration cycle apparatus according to Embodiment 3 will now be described.

For example, when the operation of the high-stage compressor 31 is stopped due to, for example, a failure of the high-stage compressor 31, the controller 50 closes the solenoid valve 17 and continues to operate the low-stage compressor 11 for a predetermined period of time before the low-stage compressor 11 is stopped. Such an operation of the controller 50 allows the low-stage refrigerant in the low-stage refrigeration cycle 10 to be stored at a high pressure between the check valve 16 and the solenoid valve 17 in the low-stage refrigeration cycle 10, particularly in the low-stage liquid receiver 15. The low-stage compressor 11 is stopped under the above-described conditions.

When the operation of the high-stage compressor 31 is stopped, a heat transfer unit for the low-stage refrigeration cycle 10 is lost. However, the low-stage refrigerant is stored at a high pressure between the check valve 16 and the solenoid valve 17 in the low-stage refrigeration cycle 10, particularly in the low-stage liquid receiver 15, and is cooled by the ambient air. Thus, the refrigerant turns into a two-phase gas-liquid state close to a state of saturated liquid, so that the refrigerant is maintained at a high density. Consequently, the low-stage refrigerant is maintained at a low pressure. This eliminates or reduces a likelihood that the pressure of the low-stage refrigerant may increase to a value higher than the disproportionation pressure of the low-stage refrigerant. Additionally, this eliminates or reduces a likelihood that the pressure of the low-stage refrigerant may exceed the upper limit pressure, or a design pressure, thus improving the reliability of the refrigeration cycle apparatus 1.

The low-stage liquid receiver 15 has such a capacity that when a pressure inside the low-stage liquid receiver 15 is lower than the disproportionation pressure of the low-stage refrigerant, the entire low-stage refrigerant in a liquid state can be stored between the check valve 16 and the solenoid valve 17. This capacity is determined based on the estimated highest temperature of the ambient air. If the temperature of the ambient air rises, an increase in pressure of the low-stage refrigerant caused by an insufficient total capacity of the components providing communication between the check valve 16 and the solenoid valve 17 is suppressed. This further eliminates or reduces the likelihood that the pressure of the low-stage refrigerant may increase to a value higher than the disproportionation pressure of the low-stage refrigerant. In addition, the likelihood that the pressure of the low-stage refrigerant may exceed the upper limit pressure, or the design pressure is further eliminated or reduced, thus further increasing the reliability of the refrigeration cycle apparatus 1.

Since the low-stage refrigerant stored between the check valve 16 and the solenoid valve 17 in the low-stage refrigeration cycle 10 is in the two-phase gas-liquid state close to the saturated liquid state, the pressure of the low-stage refrigerant can be obtained from the temperature of the low-stage refrigerant. Consequently, the pressure resistance of part of the low-stage refrigeration cycle 10 between the check valve 16 and the solenoid valve 17 can be determined based on a pressure converted from the estimated highest temperature of the ambient air.

<Behavior of Refrigeration Cycle Apparatus>

The behavior of the refrigeration cycle apparatus according to Embodiment 3 will now be described.

In the refrigeration cycle apparatus 1, when the high-stage compressor 31 is stopped, the low-stage refrigerant is maintained at a pressure lower than the disproportionation pressure of the low-stage refrigerant. Although the low-stage refrigerant is a refrigerant that undergoes disproportionation, such as HFO-1123 refrigerant, the refrigeration cycle apparatus 1 can be operated as if the low-stage refrigerant were not a refrigerant that undergoes disproportionation. This increases the possibility of, for example, improved safety of the refrigeration cycle apparatus 1, reduced cost of the refrigeration cycle apparatus 1, improved energy-saving performance of the refrigeration cycle apparatus 1, and reduced effect of the refrigeration cycle apparatus 1 on global warming.

Although Embodiments 1 to 3 have been described above, the present invention is not limited to the above description of Embodiments 1 to 3. For example, all or some of Embodiments 1 to 3. Examples 1 to 4, and modifications can be combined.

REFERENCE SIGNS LIST

1: refrigeration cycle apparatus; 10: low-stage refrigeration cycle; 11: low-stage compressor; 12: low-stage condenser; 13: low-stage expansion valve; 14: low-stage evaporator; 15: low-stage liquid receiver; 15*a*: fusible plug; 16: check valve; 17: solenoid valve; 21: low-stage high-pressure side pressure sensor; 22: low-stage low-pressure side pressure sensor; 23: low-stage discharge temperature sensor; 30: high-stage refrigeration cycle; 31: high-stage compressor; 32: high-stage condenser; 33: high-stage expansion valve; 34: high-stage evaporator; 35: cooler; 40: cascade condenser; and 50: controller.

The invention claimed is:

1. A refrigeration cycle apparatus comprising:

a low-stage refrigeration cycle including a low-stage compressor, a low-stage condenser, a low-stage pressure reducing device, and a low-stage evaporator, and circulating low-stage refrigerant;

a high-stage refrigeration cycle including a high-stage compressor, a high-stage condenser, a high-stage pressure reducing device, and a high-stage evaporator, and circulating high-stage refrigerant;

a cascade condenser configured to exchange heat between the low-stage refrigerant in the low-stage condenser and the high-stage refrigerant in the high-stage evaporator; and a controller, the low-stage refrigerant being a refrigerant that undergoes disproportionation, wherein the controller is configured to maintain the low-stage refrigerant at a pressure lower than a disproportionation pressure at which the low-stage refrigerant undergoes disproportionation.

2. The refrigeration cycle apparatus of claim 1, wherein the controller is configured to change a low-pressure side pressure of the high-stage refrigeration cycle to maintain the low-stage refrigerant at a pressure lower than the disproportionation pressure of the low-stage refrigerant.

3. The refrigeration cycle apparatus of claim 2, wherein the controller is configured to reduce the low-pressure side pressure of the high-stage refrigeration cycle when a cooling load on the low-stage refrigeration cycle increases, and the controller is configured to increase the low-pressure side pressure of the high-stage refrigeration cycle when the cooling load on the low-stage refrigeration cycle decreases.

4. The refrigeration cycle apparatus of claim 2, wherein the controller is configured to control the high-stage compressor to change the low-pressure side pressure of the high-stage refrigeration cycle.

5. The refrigeration cycle apparatus of claim 1, wherein the controller is configured to operate the high-stage compressor while the low-stage compressor is not operating, thereby maintaining the low-stage refrigerant at a pressure lower than the disproportionation pressure of the low-stage refrigerant.

6. The refrigeration cycle apparatus of claim 1, wherein the low-stage refrigeration cycle includes a low-stage liquid receiver provided in a passage communicating between the low-stage condenser and the low-stage pressure reducing device.

7. The refrigeration cycle apparatus of claim 6, wherein the low-stage refrigerant in the low-stage liquid receiver is cooled while the low-stage compressor is not operating.

8. The refrigeration cycle apparatus of claim 6, wherein the low-stage refrigeration cycle includes a check valve provided in a passage communicating between the low-stage compressor and the low-stage condenser, and a valve provided in a passage communicating between the low-stage liquid receiver and the low-stage pressure reducing device, and wherein the controller is configured to, when the high-stage compressor is stopped, maintain a state of operating of the low-stage compressor while closing the valve and then stop the low-stage compressor to maintain the low-stage refrigerant at a pressure lower than the disproportionation pressure of the low-stage refrigerant.

9. The refrigeration cycle apparatus of claim 1, wherein the low-stage refrigeration cycle includes a pressure relief device.

10. The refrigeration cycle apparatus of claim 1, wherein the controller is configured to stop, when at least one of a pressure and a temperature of the low-stage refrigerant exceeds a reference value, the low-stage compressor to maintain the low-stage refrigerant at a pressure lower than the disproportionation pressure of the low-stage refrigerant.

11. The refrigeration cycle apparatus of claim 1, wherein the high-stage refrigerant is a refrigerant that allows operating efficiency of a refrigeration cycle to be higher than that of the refrigeration cycle using the low-stage refrigerant.

12. The refrigeration cycle apparatus of claim 1, wherein the low-stage refrigerant contains HFO-1123 refrigerant.

13. The refrigeration cycle apparatus of claim 12, wherein the low-stage refrigerant is a refrigerant mixture of HFO-1123 refrigerant and a HFC-based refrigerant.

14. The refrigeration cycle apparatus of claim 13, wherein the HFC-based refrigerant is HFC-32 refrigerant.

15. The refrigeration cycle apparatus of claim 12, wherein the low-stage refrigerant is a refrigerant mixture of HFO-1123 refrigerant and HFO-1234yf refrigerant.

16. A refrigeration cycle apparatus comprising:

a low-stage refrigeration cycle including a low-stage compressor, a low-stage condenser, a low-stage pressure reducing device, and a low-stage evaporator, and circulating low-stage refrigerant;

a high-stage refrigeration cycle including a high-stage compressor, a high-stage condenser, a high-stage pressure reducing device, and a high-stage evaporator, and circulating high-stage refrigerant;

a cascade condenser configured to exchange heat between the low-stage refrigerant in the low-stage condenser and the high-stage refrigerant in the high-stage evaporator; and a controller, the low-stage refrigerant being a refrigerant that undergoes disproportionation, the low-stage refrigerant being maintained at a pressure lower than a disproportionation pressure at which the low-stage refrigerant undergoes disproportionation, wherein the low-stage refrigeration cycle includes a low-stage high-pressure side pressure detecting unit configured to detect a high-pressure side pressure of the low-stage refrigeration cycle, and a low-stage low-pressure side pressure detecting unit configured to detect a low-pressure side pressure of the low-stage refrigeration cycle, and wherein the controller is configured to control the high-pressure side pressure, detected by the low-stage high-pressure side pressure detecting unit, to be close to a geometric mean of the disproportionation pressure of the low-stage refrigerant and the low-pressure side pressure detected by the low-stage low-pressure side pressure detecting unit, thereby maintaining the low-stage refrigerant at a pressure lower than the disproportionation pressure of the low-stage refrigerant.

17. A refrigeration cycle apparatus comprising:

a low-stage refrigeration cycle including a low-stage compressor, a low-stage condenser, a low-stage pressure reducing device, and a low-stage evaporator, and circulating low-stage refrigerant;

a high-stage refrigeration cycle including a high-stage compressor, a high-stage condenser, a high-stage pressure reducing device, and a high-stage evaporator, and circulating high-stage refrigerant;

a cascade condenser configured to exchange heat between the low-stage refrigerant in the low-stage condenser and the high-stage refrigerant in the high-stage evaporator; and a controller, the low-stage refrigerant being a refrigerant that undergoes disproportionation, the low-stage refrigerant being maintained at a pressure lower than a disproportionation pressure at which the low-stage refrigerant undergoes disproportionation, wherein the low-stage refrigeration cycle includes a check valve provided in a passage communicating between the low-stage compressor and the low-stage condenser, and a valve provided in a passage communicating between the low-stage liquid receiver and the low-stage pressure reducing device, and wherein the controller is configured to maintain a state of operating of the low-stage compressor while closing the valve and then stop the low-stage compressor to cool the low-stage refrigerant between the check valve and the valve, thereby maintaining the low-stage refrigerant at a pressure lower than the disproportionation pressure of the low-stage refrigerant.

18. The refrigeration cycle apparatus of claim 17, wherein the controller is configured to maintain, when the high-stage compressor is stopped, the state of operating of the low-stage compressor while closing the valve and then stop the low-stage compressor to maintain the low-stage refrigerant at a pressure lower than the disproportionation pressure of the low-stage refrigerant.

19. The refrigeration cycle apparatus of claim 8, wherein a total capacity of components providing communication between the check valve and the valve is greater than a maximum volume of the low-stage refrigerant in a liquid state at a pressure lower than the disproportionation pressure of the low-stage refrigerant.

20. A method for controlling a refrigeration cycle apparatus including: a low-stage refrigeration cycle including a low-stage compressor, a low-stage condenser, a low-stage pressure reducing device, and a low-stage evaporator, and circulating low-stage refrigerant; a high-stage refrigeration cycle including a high-stage compressor, a high-stage condenser, a high-stage pressure reducing device, and a high-stage evaporator, and circulating high-stage refrigerant; and a cascade condenser configured to exchange heat between the low-stage refrigerant in the low-stage condenser and the high-stage refrigerant in the high-stage evaporator, the low-stage refrigerant being a refrigerant that undergoes disproportionation, the method comprising maintaining the low-stage refrigerant at a pressure lower than a disproportionation pressure at which the low-stage refrigerant undergoes disproportionation.

* * * * *